United States Patent [19]

Hori et al.

[11] 4,321,011

[45] Mar. 23, 1982

[54] FAN ASSEMBLY

[75] Inventors: Takanobu Hori, Toyota; Motoharu Yoshida, Ichinomiya, both of Japan

[73] Assignee: Aisin Seiki Kabushiki Kaisha, Kariya, Japan

[21] Appl. No.: 94,566

[22] Filed: Nov. 15, 1979

[30] Foreign Application Priority Data

Nov. 23, 1978 [JP] Japan ..... 53-145068
Apr. 7, 1979 [JP] Japan ..... 54-042132

[51] Int. Cl.[3] ..... F04D 29/34
[52] U.S. Cl. ..... 416/214 R; 416/241 A
[58] Field of Search ..... 416/169 A, 241 A, 214 R, 416/134, 154; 403/28, 408

[56] References Cited

U.S. PATENT DOCUMENTS

| | | | |
|---|---|---|---|
| 2,041,555 | 5/1936 | Lee | 416/134 |
| 2,212,072 | 8/1940 | Newnham | 416/134 |
| 3,183,842 | 5/1965 | Sadler | 418/154 |
| 3,307,634 | 3/1967 | Bihlmire | 416/134 |
| 3,415,553 | 12/1968 | Baugh | 403/408 |
| 3,584,969 | 6/1971 | Lobashi | 416/241 A |
| 3,622,249 | 11/1971 | Hayashi | 416/241 A |
| 4,245,957 | 1/1981 | Sauage | 416/241 A |

FOREIGN PATENT DOCUMENTS

| | | | |
|---|---|---|---|
| 2842986 | 12/1979 | Fed. Rep. of Germany | 403/408 |
| 1435864 | 5/1976 | Fed. Rep. of Germany | 416/241 A |
| 1437352 | 5/1976 | United Kingdom | 403/28 |

*Primary Examiner*—William L. Freeh
*Attorney, Agent, or Firm*—Oblon, Fisher, Spivak, McClelland & Maier

[57] ABSTRACT

A fan assembly including a hub portion from which blades and a stem are extended respectively radially outwardly and radially inwardly, the hub portion, the blades and the stem being formed of molded plastics and made integral with each other. The stem is connected to an output shaft of fluid coupling by means of bolts each of which passes through a bushing. The bushing having knurling portion at outer surface thereof is inserted in the hole of the stem and the periphery of the hole is melted by heating upon insertion of the bushing therein so as to ensure the connection of the fan assembly to the output member. In case that a spacer is interposed between the stem and a flange of the bush, the spacer is fixedly connected to the bushing.

15 Claims, 11 Drawing Figures

FAN ASSEMBLY

BACKGROUND OF THE INVENTION

1. Field of the Invention

This invention relates to a fan assembly for automotive vehicles and more particularly to a bushing through which a bolt for connecting the fan assembly to an output member of internal combustion engine is passed.

2. Description of the Prior Art

Conventionally, the fan assembly has been used for cooling a radiator in an automotive vehicle. The fan assembly includes a hub portion including a stem extending radially inwardly therefrom and blades extending radially outwardly therefrom. The hub portion of the fan assembly is made of molded plastic for simplicity of manufacturing and prevention of noise occasionally produced by metal blades.

The stem of the hub portion is circumferentially provided with a plurality of holes, each hole being inserted with the bushing through which the bolt is passed for connecting the fan assembly to, for instance, the output shaft of the fluid coupling. However, the stem is subject to deformation due to the environmental temperature-variation therearound with the result that loosening of the connection between the stem and the bushing is caused. Therefore, it is hard to transmit the engine-torque from the output shaft of the fluid coupling to the stem of fan assembly without any loss thereof.

On the other hand, in some kinds of fan assemblies a spacer is additionally interposed between the stem and a flange of the bushing to thereby improve such torque transmission. But, since it is also hard to fix the spacer and the bushing with each other, the engine-torque will not be effectively transmitted to the fan assembly.

SUMMARY OF THE INVENTION

It is, therefore, one of the objects of this invention to provide a fan assembly without the difficulties of the prior art as mentioned above.

It is another object of this invention to provide a fan assembly in which a bushing is provided with a knurled outer surface to be effectively secured to the stem portion of the fan assembly.

It is a further object of this invention to provide a fan assembly in which a spacer is interposed between the stem portion and the bushing flanges to improve the torque transmission to the fan assembly from an output member of internal combustion engine in cooperation with the knurled bushing.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
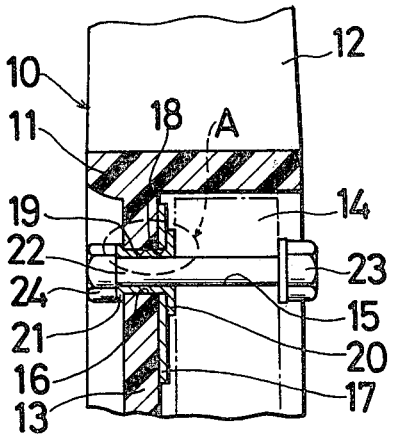
FIG. 1 is a portion of longitudinal cross-sectional view of a fan assembly according to the invention.

Referring now to FIG. 1, there is illustrated a portion of a fan assembly 10 having a hub portion 11. The hub portion 11 is provided with a plurality of blades 12 extending radially outwardly therefrom and is also provided with a stem 13 projecting radially inwardly therefrom. All of the hub portion 11, blades 12 and the stem 13 are formed of molded plastic and are made integrally with each other. An output shaft 14 of the fluid coupling is located in the hub portion 11 and is provided with a plurality of circumferentially arranged axial holes 15. The stem 13 is also provided with a plurality of circumferentially arranged axial holes 16. An annular spacer 17 with a plurality of circumferentially arranged axial holes 18 is provided in abutment to the right face of the stem 13. The holes 15, 16 and 18 are disposed coaxially with each other.

Figure 3:
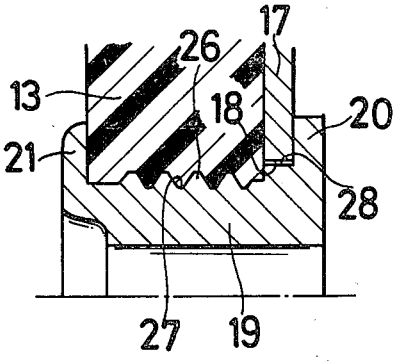
FIG. 3 is an enlarged view of a portion encircled by broken line A in FIG. 1.

A bushing 19 is rigidly inserted in the hole 16 of the stem 13 and the hole 18 of the spacer 17 and is provided with an annular flange 20 extending radially outwardly therefrom at right end thereof and the flange 20 is interposed between the right side of the spacer 17 and the left side of the output shaft 14. The left end of the bushing 19 is caulked to be engaged with the left side of the stem 13 as shown in FIG. 3. Thus, the spacer 17 is fixedly interposed between the stem 13 and the flange 20 of the bushing 19.

A bolt 22 having a head 23 at the right end thereof is passed through the hole 15 of the output shaft 14 and the bushing 19 from right-hand to left-hand, and the left end of the bolt 22 is provided with a nut 24. Thus, the fan assembly 10 and the fluid coupling are fixedly connected.

Figure 2:
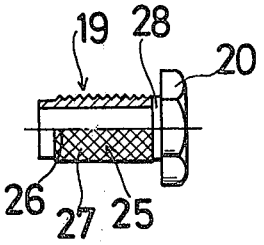
FIG. 2 is a partially cross-sectional view of a bush employed in the fan assembly of FIG. 1.

As seen in FIG. 2, the bushing 19 is provided with a knurled portion 25 on the outer surface thereof so as to ensure a firm connection between the bushing 19 and the stem 13. In the knurled portion 25, there are formed a series of small ridges 26 and a series of small dents or indentations 27. The bushing 19 is also provided with a non-knurled portion 28 between the knurled portion 25 and the flange 20, and the axial length of the non-knurled portion 28 is substantially identical with a thickness of the spacer 17.

Upon inserting the bushing 19 into the spacer 17 and the stem 13 while keeping its temperature over the melting point of the plastics, the bushing 19 is fixedly connected to the stem 13 because the periphery of the hole 16 of the stem 13 is melted and the dents or indentations 27 are filled with plastic (FIG. 3). In other words, the knurled portion 25 bites into the stem 13. Thus, once the bushing 19 is inserted into the hole 16 of the stem 13 in such manner, a connecting force is generated between the stem 13 and the bushing 19 to prevent a loose connection between the stem 13 and the bushing 19 upon environmental thermal-variation around the fan assembly 10 or vibrations of the bushing 19 caused by the engine.

One of the methods for melting the periphery of the stem hole 16 is to heat the bushing 19 over the melting point of plastic before insertion of the bushing 19. Another method is to transmit the ultrasonic wave to the periphery of the stem hole 16 during insertion of the bushing 19.

In order to confirm the effect of this invention by measuring the connecting force, various experiments have been conducted under the same conditions. In advance of these experiments, the module of knurling is set at 0.5 mm, the interference (obtained by substracting the diameter of the hole 16 from the diameter of the bushing 19) is set at 0.5 mm and the bushing 19 is inserted in the hole 16 of the stem 13 while keeping the temperature of the bushing 19 at approximately 300° C. The connecting force of the fan assembly 10 constituted as mentioned hereinbefore is measured again after driving of the fan assembly at 3120 r.p.m. for 10 minutes running under 100° C. environmental temperature. As a result of the measurements, the connecting force covers 280 kg-cm to 320 kg-cm.

On the contrary, in case bushing 19 is not inserted into the hole 16 without heating, the connecting force covers 130 kg-cm to 150 kg-cm under the same conditions as mentioned above. Further, in case a bushing 19 without knurling is inserted in the hole 16 of the stem 13, the connecting force ranges from 90 kg-cm to 110 kg-cm.

With a view to more effectively transmiting engine-torque from the output shaft 14 of the fluid coupling to the fan assembly 10, the bushing 19 has to be fixedly connected to the spacer 17. More particularly, assuming that the bushing 19 is not connected fixedly to the spacer 17, the frictional force between the stem 13 and the spacer 17 and the frictional force between the spacer 17 and the flange 20 of the bushing 19 are subject to decrease due to the vibration of the spacer 17 or the circumferential rotation of the spacer 17. Therefore, engine-torque is not effectively transmitted to the stem 13 from the bushing 19 through the spacer 17.

Furthermore, noise may be generated due to the clearance between the spacer 17 and the flange 20 of the bushing 19 caused by frictional wear. This is the reason why the bushing 19 should be connected fixedly to the spacer 17. In order to realize such firm connection between the bushing 19 and the spacer 17, at first, in FIG. 3, the non-knurled portion 28 of the bushing 19 is pressed into the hole 18 of spacer 17.

Figure 4:
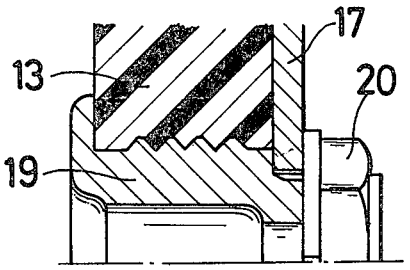
FIG. 4 is a view similar to FIG. 3 but showing a first modified embodiment of the invention.

In FIG. 4, the bushing 19 is screwed into the spacer 17 and a nut 20' is screwed on the bushing 19 so as to press the spacer 17 on the right end of the stem 13 instead of the flange 20 of the bushing 19. Thus, the spacer 17, the bushing 19 and the stem 13 are fixedly connected with each other to thereby transmit engine-torque effectively from the engine to the fan assembly 10 through the fluid coupling, the bushing 19 and the spacer 17.

Figure 5:
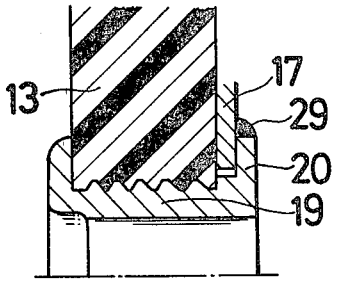
FIG. 5 is a view similar to FIG. 3 but showing a second modified embodiment.
Figure 6:
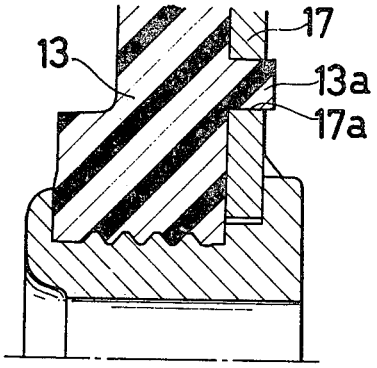
FIG. 6 is a view similar to FIG. 3 but showing a fourth modified embodiment.

In FIG. 5, the bushing 19 is screwed in the spacer 17 and the stem 13. In addition, the spacer 17 and the flange 20 of the bushing 19 are connected with each other by welding means 29. Thus, the spacer 17, the bushing 19 and the stem 13 are connected fixedly with each other. In FIG. 6, the spacer 17 is connected to the stem 13 by fitting a projection **13*a* of the stem 13 into an aperture 17*a* of the spacer 17 in addition to the spacer in FIG. 5**.

Figure 7:
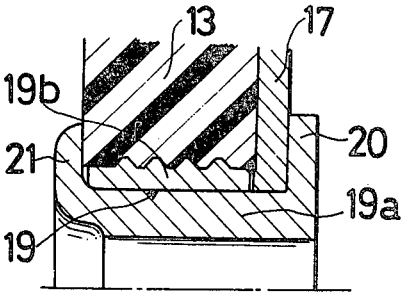
FIG. 7 is a view similar to FIG. 3 but showing 3 fifth modified embodiment.

In FIG. 7, the bushing 19 is separated into an inner portion **19*a* and an outer portion 19*b* for easy assembly of the fan assembly 10. The outer portion 19*b* includes the knurled portion 25. The inner portion 19*a* having the flange 20 at right end thereof is passed through the outer portion 19*b* and the left end of the inner portion 19*a* is caulked. Thus, the stem 13, the outer portion 19*b* and the spacer 17 are fixedly held between the flange 20 and the caulked portion 21**.

Figure 8:
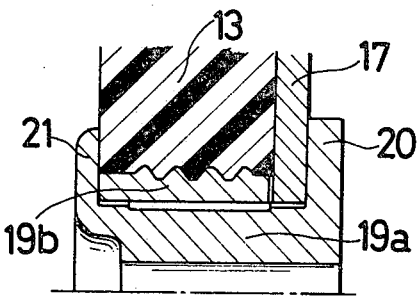
FIG. 8 is a view similar to FIG. 3 but showing a sixth modified embodiment.
Figure 9:
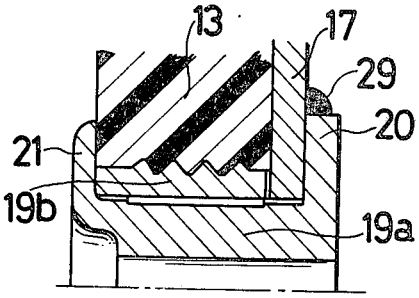
FIG. 9 is a view similar to FIG. 3 but showing a seventh modified embodiment.
Figure 10:
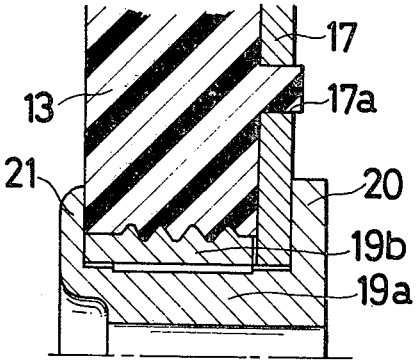
FIG. 10 is a view similar to FIG. 3 but showing an eighth modified embodiment.
Figure 11:
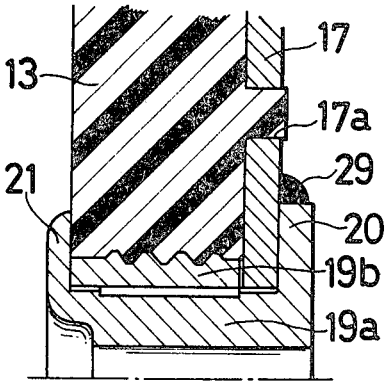
FIG. 11 is a view similar to FIG. 3 but showing a ninth modified embodiment.

In order to connect the inner portion **19*a* fixedly to the outer portion 19*b* and the spacer 17, the inner portion 19*a* is screwed in the spacer 17 and the outer portion 19*b* as shown in FIG. 8. In addition, as shown in FIG. 9, the spacer 17 may be connected to the flange 20 by means of welding 29, and as shown in FIG. 10, the spacer 17 may be connected to the stem 13 by fitting the projection 13*a* of the latter in the aperture 17*a* of the former. Furthermore, as shown in FIG. 11, the spacer 17 may be connected to the flange 20 by means of welding 29 and to the stem 13 by fitting the projection 13*a* of the stem 13 in the aperture 17*a* of the spacer 17. As mentioned above, the fan assembly 10** to which engine-torque may be effectively transmitted may be obtained by the bush having the knurled portion thereon.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fan assembly driven by an output member of an internal combustion engine of an automotive vehicle comprising:

a hub portion formed of molded plastic;

a plurality of blades extending radially outwardly from said hub portion;

a stem projecting radially inwardly from said hub portion and including a plurality of axial holes formed therein, said blades and said stem being integral with said hub portion;

a plurality of bushings inserted in said holes, each of said bushings including a flange formed at one end thereof interposed between one side of said stem and said output member, a caulked portion at the other end thereof rigidly connected to the other side of said stem and a knurled portion on an outer surface thereof for securing said stem thereto;

a plurality of bolts passing through said output member and said bushings for securing said hub portion to said output member; and a spacer having a plurality of axial holes formed therein, said spacer being interposed between said flange of said bushings and one side of said stem and said bolts being mounted within said holes of said spacer wherein said spacer and each of said bushings are fixedly connected to each other, and wherein said bushings are provided with a non-knurled portion on the outer surface between said knurled portion and said flange, and said non-knurled portion rigidly connected to said spacer.

2. A fan assembly in accordance with claim 1, wherein said bushings are respectively pressed into said holes of said spacer.

3. A fan assembly in accordance with claim 1, wherein said non-knurled portion of said bushings are screwed into said holes of said spacer, respectively.

4. A fan assembly in accordance with claim 3, wherein said flanges of said bushings are welded to said spacer.

5. A fan assembly in accordance with claim 4, said stem further comprising a plurality of projections and said spacer includes a plurality of apertures formed therein wherein said plurality of projections are disposed within said apertures.

6. A fan assembly in accordance with claim 1, wherein each of said bushings are separated into a first member including said knurled portion and a second member enclosing said flange and said caulking portion.

7. A fan assembly in accordance with claim 6, wherein said second member is fixedly connected to said first member and said spacer.

8. A fan assembly in accordance with claim 7, wherein said second member is pressedly mounted within said holes of said spacer and said first member.

9. A fan assembly in accordance with claim 7, wherein said second member is screwed into said hole of said spacer and said first member.

10. A fan assembly in accordance with claim 9, said stem further comprising a plurality of projections and said spacer includes a plurality of apertures formed therein wherein said plurality of projections are disposed within said apertures.

11. A fan assembly in accordance with claim 9, wherein said flange of said second member is welded to said spacer.

12. A fan assembly in accordance with claim 10, said stem further comprising a plurality of projections and said spacer includes a plurality of apertures formed therein wherein said plurality of projections are disposed within said apertures.

13. A fan assembly in accordance with claims 1 or 2, wherein said bushings are inserted in said holes of said stem while keeping the temperature of said stem over the melting point of plastic by directly heating said bushing.

14. A fan assembly in accordance with claim 13, wherein said bushings are heated over the melting point of plastic before insertion into said holes of said stem.

15. A fan assembly in accordance with claim 13, wherein an inner periphery of said stem is melted by ultrasonic wave transmitted thereto during insertion of said bushings into said holes of said stem.

* * * * *